US009447708B2

(12) United States Patent
Choi

(10) Patent No.: US 9,447,708 B2
(45) Date of Patent: Sep. 20, 2016

(54) ELECTRO-HYDRAULIC VALVE TRAIN

(71) Applicants: Hyundai Motor Company, Seoul (KR); Kia Motors Corporation, Seoul (KR)

(72) Inventor: Myungsik Choi, Whasung-Si (KR)

(73) Assignees: Hyundai Motor Company, Seoul (KR); Kia Motors Corporation, Seoul (KR)

( * ) Notice: Subject to any disclaimer, the term of this patent is extended or adjusted under 35 U.S.C. 154(b) by 219 days.

(21) Appl. No.: 14/255,782

(22) Filed: Apr. 17, 2014

(65) Prior Publication Data

US 2014/0225012 A1 Aug. 14, 2014

Related U.S. Application Data

(62) Division of application No. 13/181,136, filed on Jul. 12, 2011, now Pat. No. 8,813,696.

(30) Foreign Application Priority Data

Nov. 12, 2010 (KR) ..... 10-2010-0112811
Dec. 3, 2010 (KR) ..... 10-2010-0123015

(51) Int. Cl.

| | |
|---|---|
| ***F01L 9/02*** | (2006.01) |
| ***F01L 1/344*** | (2006.01) |
| ***F01L 13/00*** | (2006.01) |
| *F01L 35/02* | (2006.01) |

(52) U.S. Cl.
CPC ..... *F01L 1/344* (2013.01); *F01L 13/0005* (2013.01); *F01L 35/02* (2013.01)

(58) Field of Classification Search
CPC ..... F01L 1/344; F01L 35/02; F01L 13/0005
USPC ..... 123/90.12, 90.39, 90.11, 90.13, 90.44
See application file for complete search history.

(56) References Cited

U.S. PATENT DOCUMENTS 7,228,826 B2 6/2007 Chang
8,468,985 B2 * 6/2013 Cho ..... F01L 1/143 123/90.12

(Continued)

FOREIGN PATENT DOCUMENTS

CN 1764787 A 4/2006
CN 1969110 A 5/2007

(Continued)

*Primary Examiner* — Ching Chang
(74) *Attorney, Agent, or Firm* — Morgan, Lewis & Bockius LLP

(57) ABSTRACT

An electro-hydraulic valve train is configured to change valve lift and valve opening/closing timing according to operation state of an engine. The electro-hydraulic valve train includes a valve stem having a valve head formed at a lower end thereof and a big-diameter stem formed at a middle portion thereof, the big-diameter stem having a larger diameter than the other portion, a swing arm having a roller contacting with a cam of a camshaft and an end connected to the valve stem, the one end being adapted to pivot with respect to the other end according to a rotation of the cam so as to move the valve stem upwardly or downwardly, a first brake unit enclosing the valve stem and adapted to perform brake operation in a case that the valve stem moves upwardly, and a second brake unit mounted at the other end of the swing arm and adapted to selectively move the other end of the swing arm upwardly or downwardly and to perform brake operation in a case that the other end of the swing arm moves downwardly.

11 Claims, 12 Drawing Sheets

(56) References Cited

U.S. PATENT DOCUMENTS

| | | | | |
|---|---|---|---|---|
| 8,813,696 | B2 * | 8/2014 | Choi | F01L 13/0005 123/90.11 |
| 2009/0031976 | A1 | 2/2009 | Genise | |

FOREIGN PATENT DOCUMENTS

| | | | |
|---|---|---|---|
| CN | 101144400 | A | 3/2008 |
| DE | 10 2004 053 202 | A1 | 6/2006 |
| JP | 2004-044399 | A | 2/2004 |

* cited by examiner

ELECTRO-HYDRAULIC VALVE TRAIN

CROSS-REFERENCE TO RELATED APPLICATION

This application is a Divisional of U.S. patent application Ser. No. 13/181,136, filed Jul. 12, 2011, which claims priority to and the benefit of Korean Patent Application Nos. 10-2010-0112811 and 10-2010-0123015 filed in the Korean Intellectual Property Office on Nov. 12, 2010 and Dec. 3, 2010, respectively, the entire contents of which applications are incorporated herein for all purposes by this reference.

BACKGROUND OF INVENTION

1. Field of Invention

The present invention relates to an electro-hydraulic valve train. More particularly, the present invention relates to an electro-hydraulic valve train that can change valve lift and valve opening/closing timing according to operation state of an engine.

2. Description of Related Art

An internal combustion engine generates power by burning fuel in a combustion chamber in air media drawn into the chamber. Intake valves are operated by a camshaft in order to intake the air, and the air is drawn into the combustion chamber while the intake valves are open. In addition, exhaust valves are operated by the camshaft, and a combustion gas is exhausted from the combustion chamber while the exhaust valves are open.

An optimal operation of the intake valves and the exhaust valves depends on a rotation speed of the engine. That is, an optimal lift or optimal opening/closing timing of the valves depends on the rotation speed of the engine. In order to achieve such an optimal valve operation depending on the rotation speed of the engine, various researches have been undertaken. For example, research has been undertaken for a variable valve lift (VVL) apparatus that enables different lifts depending on an engine speed, and for a variable valve timing (VVT) apparatus that opens/closes the valves with different timing depending on the engine speed.

Meanwhile, an electro hydraulic valve train (EHV) which controls close timing of a valve by using hydraulic pressure has been researched.

Such an EHV has advantages of controlling opening/closing timing of the valve by controlling release timing of the hydraulic pressure, but has drawbacks of requiring additional devices for controlling valve lift.

In addition, a hydraulic pump generates hydraulic pressure by operation of a camshaft, and the EHV, the hydraulic pump, and hydraulic pressure lines are provided above valves so as to supply the hydraulic pressure to the EHV. Therefore, an engine layout should be changed in order to apply a conventional EHV to the engine using a swing arm.

The information disclosed in this Background section is only for enhancement of understanding of the general background of the invention and should not be taken as an acknowledgement or any form of suggestion that this information forms the prior art already known to a person skilled in the art.

SUMMARY OF INVENTION

Various aspects of the present invention provide for an electro-hydraulic valve train having advantages of being applied to an engine with hardly changing an engine layout by mounting brake units respectively at a valve portion and a pivot portion.

Various aspects of the present invention provide for an electro-hydraulic valve train having further advantages of changing a valve lift by changing a position of a pivot portion of a swing arm.

An electro-hydraulic valve train according to various aspects of the present invention may include a valve stem having a valve head formed at a lower end thereof and a big-diameter stem formed at a middle portion thereof, the big-diameter stem having a larger diameter than the other portion, a swing arm having a roller contacting with a cam of a camshaft and an end connected to the valve stem, the one end being adapted to pivot with respect to the other end according to a rotation of the cam so as to move the valve stem upwardly or downwardly, a first brake unit enclosing the valve stem and adapted to perform brake operation in a case that the valve stem moves upwardly, and a second brake unit mounted at the other end of the swing arm and adapted to selectively move the other end of the swing arm upwardly or downwardly and to perform brake operation in a case that the other end of the swing arm moves downwardly.

The first brake unit may include a first housing being a hollow shape, and having a first interior portion at which the big-diameter stem is positioned and a second interior portion formed at an upper portion of the first interior portion, an upper portion of the valve stem being positioned at the second interior portion, a first brake chamber formed between an upper portion of the big-diameter stem and an upper end portion of the first interior portion, and a first supply line connected to the first brake chamber so as to supply hydraulic pressure thereto and adapted to be closed by the big-diameter stem selectively.

The hydraulic pressure supplied to the first brake chamber may be adapted to impede upward movement of the valve stem and to flow out from the first brake chamber through a space between the big-diameter stem and the first interior portion in a case that the valve stem moves upwardly.

A stem seal may be mounted at a lower portion of the first interior portion and may closely contact with an exterior circumference of the big-diameter stem.

The second brake unit may include a second housing being hollow shape and having a third interior portion and a fourth interior portion formed at a lower portion of the third interior portion and having a smaller diameter than the third interior portion, a master piston coupled to the other end of the swing arm and movably inserted in the third interior portion, a slave piston disposed under the master cylinder with a distance, and having an upper end portion movably inserted in the third interior portion and a middle portion integrally connected to a lower end of the upper end portion and movably inserted in the fourth interior portion, a piston chamber formed by the master piston, the slave piston, and the third interior portion, a second brake chamber formed between a lower end of the upper end portion of the slave piston and a lower end portion of the third interior portion, a second supply line adapted to supply hydraulic pressure to the piston chamber, and a third supply line connected to the second brake chamber so as to supply hydraulic pressure thereto, and adapted to be closed by the upper end portion of the slave piston selectively.

The second brake unit may further include a first spring disposed in the piston chamber and adapted to supply elastic force pushing the master piston toward the swing arm.

The second brake unit may further include a stopper fixed to the third interior portion so as to support the first spring and restricting an upward movement of the slave piston.

The second brake unit further comprises a connecting line connecting an exterior circumference of the middle portion and a lower end of the slave piston and connected to the second brake chamber so as to flow out hydraulic pressure of the second brake chamber.

The electro-hydraulic valve train may further include a second spring interposed between the second housing and the lower end of the slave piston and supplying elastic force pushing the slave piston toward the master piston.

The second brake unit may further include a latching piston selectively fixing the master cylinder to the second housing.

The latching piston may be movable horizontally in the master cylinder, and the third interior portion having a latching groove in which the latching piston may be selectively inserted.

The latching groove may be connected to a fourth supply line supplying hydraulic pressure to the latching piston, and a latching spring supplying elastic force to the latching piston against the hydraulic pressure may be mounted in the master cylinder.

An electro-hydraulic valve train according to other aspects of the present invention may include a brake piston having a small-diameter portion formed at an upper portion thereof and a big-diameter portion having a smaller diameter than the small-diameter portion and formed at a lower portion thereof, a valve stem having a valve head formed at a lower end thereof and an upper end portion coupled with the brake piston, a swing arm having a roller contacting with a cam of a camshaft and an end coupled to an upper end of the brake piston, the one end being adapted to pivot with respect to the other end according to a rotation of the cam so as to move the valve stem and the brake piston upwardly or downwardly, a first brake unit enclosing the brake piston and adapted to perform brake operation in a case that the brake piston moves upwardly, and a second brake unit mounted at the other end of the swing arm and adapted to selectively move the other end of the swing arm upwardly or downwardly and to perform brake operation in a case that the other end of the swing arm moves downwardly.

The first brake unit may include a first housing having a first interior portion at which the small-diameter portion is positioned and a second interior portion formed at a lower portion of the first interior portion, the big-diameter portion being positioned at the second interior portion, a first brake chamber formed between an upper end of the big-diameter portion and an upper end portion of the first interior portion, and a first supply line connected to the first brake chamber so as to supply hydraulic pressure thereto, formed at the first housing, and adapted to be closed by the big-diameter portion.

The hydraulic pressure supplied to the first brake chamber may be adapted to impede upward movement of the brake piston and to flow out from the first brake chamber through a space between the big-diameter portion and the second interior portion in a case that the brake piston moves upwardly.

The second brake unit may include a second housing being hollow shape and having a third interior portion and a fourth interior portion formed at a lower portion of the third interior portion and having a smaller diameter than the third interior portion, a master piston coupled to the other end of the swing arm and movably inserted in the third interior portion, a slave piston disposed under the master cylinder with a distance, and having an upper end portion movably inserted in the third interior portion and a middle portion integrally connected to a lower end of the upper end portion and movably inserted in the fourth interior portion, a piston chamber formed by the master piston, the slave piston, and the third interior portion, a second brake chamber formed between a lower end of the upper end portion of the slave piston and a lower end portion of the third interior portion, a second supply line adapted to supply hydraulic pressure to the piston chamber, and a third supply line connected to the second brake chamber so as to supply hydraulic pressure thereto, and adapted to be closed by the upper end portion of the slave piston selectively.

The second brake unit may further include a first spring disposed in the piston chamber and adapted to supply elastic force pushing the master piston toward the swing arm.

The second brake unit may further include a stopper fixed to the third interior portion so as to support the first spring and restricting an upward movement of the slave piston.

The second brake unit may further include a connecting line connecting an exterior circumference of the middle portion and a lower end of the slave piston and connected to the second brake chamber so as to flow out hydraulic pressure of the second brake chamber.

The electro-hydraulic valve train may further include a second spring interposed between the second housing and the lower end of the slave piston and supplying elastic force pushing the slave piston toward the master piston.

The second brake unit may further include a latching piston selectively fixing the master cylinder to the second housing.

The latching piston may be movable horizontally in the master cylinder, and the third interior portion having a latching groove in which the latching piston may be selectively inserted.

The latching groove may be connected to a fourth supply line supplying hydraulic pressure to the latching piston, and a latching spring supplying elastic force to the latching piston against the hydraulic pressure may be mounted in the master cylinder.

The methods and apparatuses of the present invention have other features and advantages which will be apparent from or are set forth in more detail in the accompanying drawings, which are incorporated herein, and the following Detailed Description, which together serve to explain certain principles of the present invention.

DETAILED DESCRIPTION

Reference will now be made in detail to various embodiments of the present invention(s), examples of which are illustrated in the accompanying drawings and described below. While the invention(s) will be described in conjunction with exemplary embodiments, it will be understood that present description is not intended to limit the invention(s) to those exemplary embodiments. On the contrary, the invention(s) is/are intended to cover not only the exemplary embodiments, but also various alternatives, modifications, equivalents and other embodiments, which may be included within the spirit and scope of the invention as defined by the appended claims.

Figure 1:
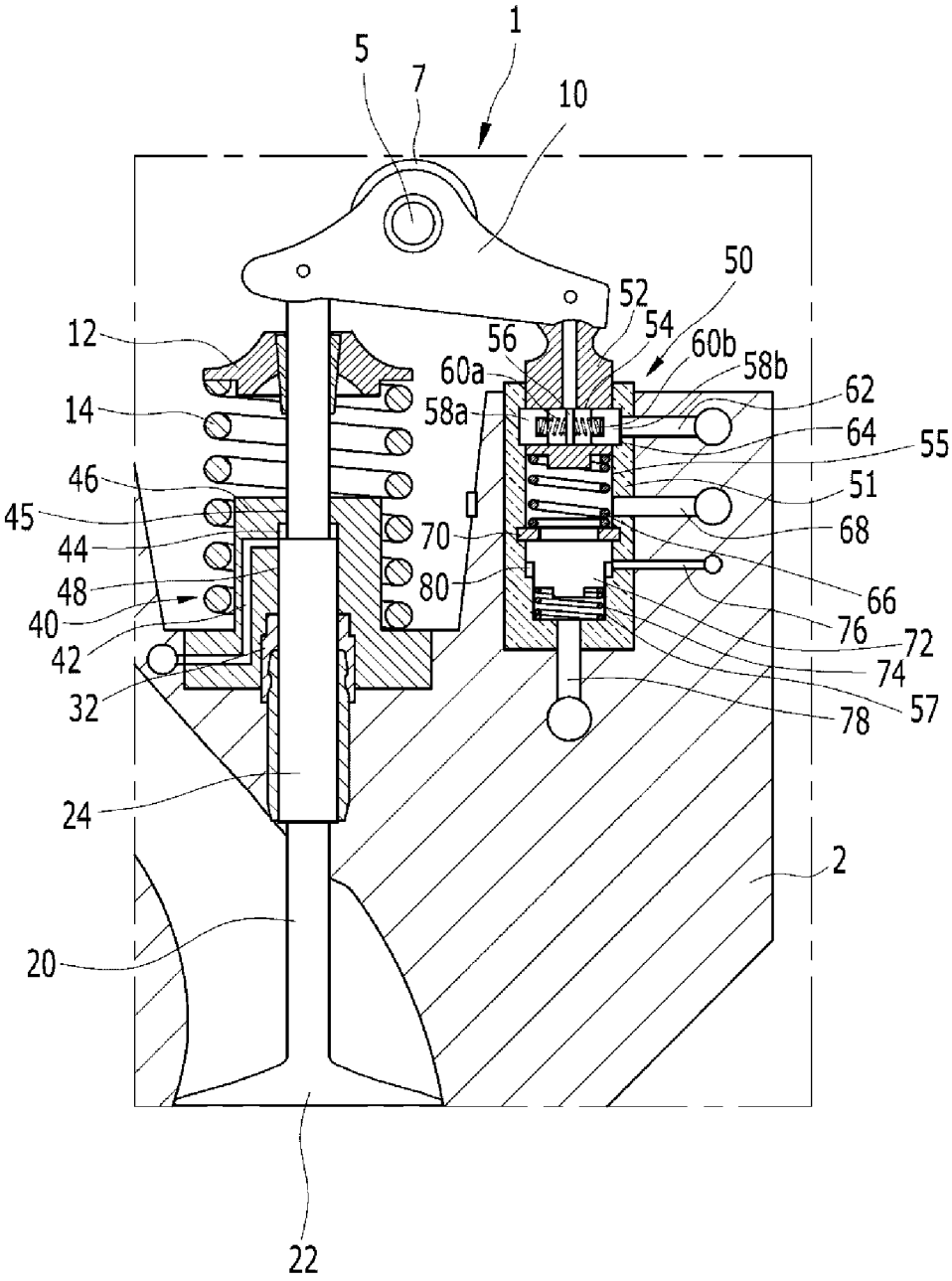
FIG. 1 is a cross-sectional view of an exemplary electro-hydraulic valve train according to various embodiments of the present invention.

As shown in FIG. 1, an electro-hydraulic valve train 1 according to various embodiments of the present invention is applied to an engine of a swing arm type. That is, a swing arm 10 is provided at an upper portion of a cylinder head 3, and a camshaft 2 is provided above the swing arm 10. In addition, a valve stem 20 is connected to an end of the swing arm 10, and a roller 7 contacting with a cam 4 of the camshaft 2 is rotatably connected to an upper portion of the swing arm 10 through a roller shaft 5. Therefore, the swing arm 10 pivots with respect to the other end thereof by the roller 7 contacting with the cam 4 when the camshaft 2 rotates. Accordingly, the valve stem 20 moves upwardly or downwardly so as to open or close an intake port or an exhaust port. In addition, a spring seat 12 is disposed at a lower portion of the end of the swing arm 10 such that the swing arm 10 pushes the spring seat 12 when the end of the swing arm 10 moves downwardly. A valve spring 14 is interposed between the spring seat 12 and the cylinder head 2. Therefore, a downward movement of the valve stem 20 is generated by the cam 4 and an upward movement of the valve stem 20 is generated by the valve spring 14.

The electro-hydraulic valve train 1 includes the valve stem 20, a first brake unit 40, and a second brake unit 50.

An upper end of the valve stem 20 is rotatably connected to the end of the swing arm 10, and a valve head 22 for closing the intake port or the exhaust port is formed at a lower end of the valve stem 20. A big-diameter stem 24 is formed at a middle portion of the valve stem 20. A diameter of the big-diameter stem 24 is larger than that of other portion of the valve stem 20.

Figure 2:
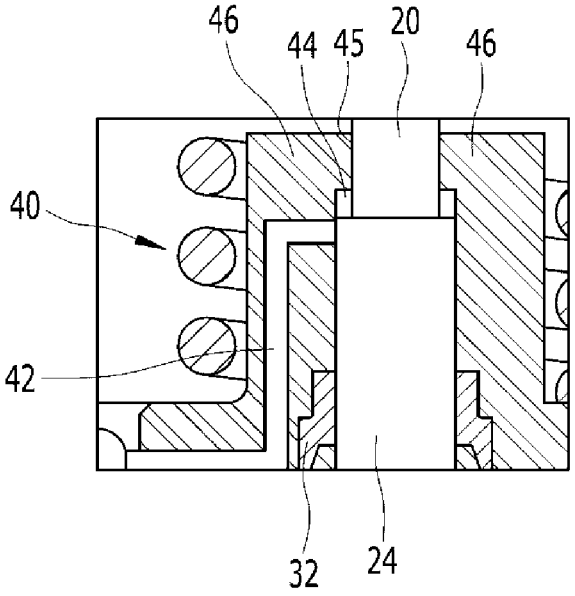
FIG. 2 is a cross-sectional view of the first brake unit included in an exemplary electro-hydraulic valve train according to the present invention.

As shown in FIG. 1 and FIG. 2, the first brake unit 40 encloses the valve stem 20 and performs brake operation when the valve stem 20 moves upwardly (i.e., the valve closes). For this purpose, the first brake unit 40 includes a first housing 46, a first brake chamber 44, and a first supply line 42.

The first housing 46 is a hollow cylindrical shape. The first housing 46 is mounted at an upper end of the cylinder head 3 or is integrally formed with the cylinder head 3. One will appreciate that first housing may be monolithically formed with the cylinder head. An interior surface of the first housing 46 includes a first interior portion 48 formed at a lower portion thereof and a second interior portion 45 formed above the first interior portion 48. A diameter of the first interior portion 48 is larger than that of the second interior portion 45. The big-diameter stem 24 is positioned at the first interior portion 48 and an upper portion of the valve stem 20 is positioned at the second interior portion 45. Therefore, a diameter of the first interior portion 48 is almost the same as that of the big-diameter stem 24, and a diameter of the second interior portion 45 is almost the same as other portion of the valve stem 20 (a portion except the big-diameter stem 24). In addition, a stem seal 32 is mounted at a lower portion of the first interior portion 48. The stem seal 32 closely contacts with an exterior circumference of the big-diameter stem 24 so as to prevent oil supplied to the first brake chamber 44 from flowing in a combustion chamber through the intake port or the exhaust port.

The first brake chamber 44 is formed between the big-diameter stem 24 and an upper end portion of the first interior portion 48 (i.e., a stepped surface between the first interior portion 48 and the second interior portion 45). Therefore, a volume of the first brake chamber 44 changes according to a movement of the valve stem 20 (particularly, the big-diameter stem 24).

The first supply line 42 is formed in the first housing 46 and is selectively connected to the first brake chamber 44. The first supply line 42 is connected to a hydraulic pump or an oil control valve so as to receive hydraulic pressure, and supplies the received hydraulic pressure to the first brake chamber 44 selectively. More concretely, the first supply line 42 is connected and supplies the hydraulic pressure to the first brake chamber 44 in a state that the valve head 22 opens the intake port or the exhaust port. If the valve stem 20 moves upwardly at this state, the big-diameter stem 24 closes the first supply line 42 and the oil remaining in the first brake chamber 44 impedes an upward movement of the valve stem 20. If the valve stem 20 further moves upwardly at this state, the oil remaining in the first brake chamber 44 flows out from the first brake chamber 44 through a space between the big-diameter stem 20 and the first interior portion 48. After that, the oil moves to an oil reservoir through an exhaust line formed at the first supply line 42 or the first interior portion 48.

Figure 3:
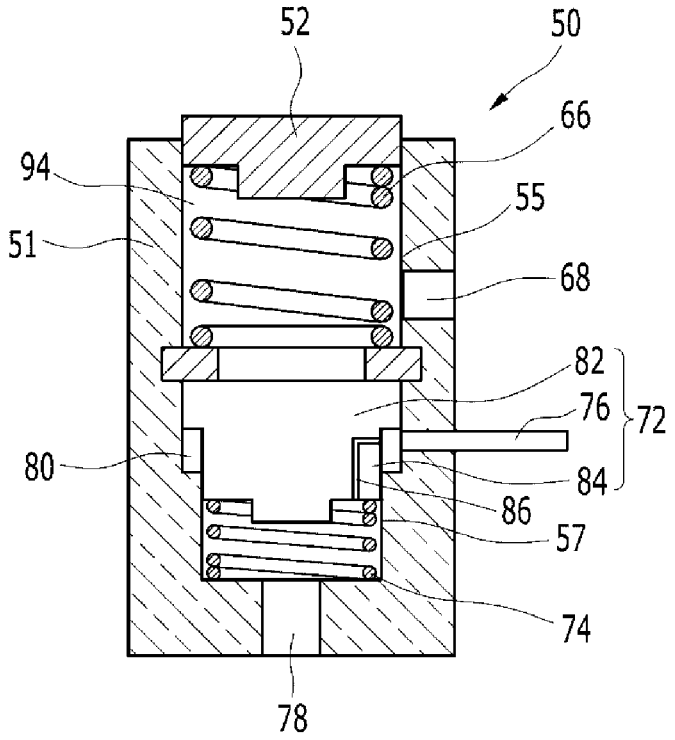
FIG. 3 is a partial cross-sectional view of the second brake unit included in an exemplary electro-hydraulic valve train according to the present invention.

As shown in FIG. 1 and FIG. 3, the second brake unit 50 is mounted at the other end of the swing arm 10 and moves the other end of the swing arm 10 upwardly or downwardly. The second brake unit 50 is adapted to perform brake operation when the other end of the swing arm 10 moves downwardly. The second brake unit 50 includes a second housing 51, a master piston 52, a slave piston 72, a piston chamber 94, a second brake chamber 80, a stopper 70, first and second springs 66 and 74, second and third supply lines 68 and 76, and an exhaust line 78.

The second housing 51 is a hollow cylindrical shape. The second housing 51 is mounted at an upper end of the cylinder head 3 or is integrally formed with the cylinder head 3. One will appreciate that second housing may be monolithically formed with the cylinder head. An interior surface of the second housing 51 includes a third interior portion 55 formed at an upper portion thereof and a fourth interior portion 57 provided under the third interior portion 55. A diameter of the third interior portion 55 is larger than that of the fourth interior portion 57.

The master piston 52 includes an upper end rotatably connected to the other end of the swing arm 10 and a lower end movably inserted in the third interior portion 55. In addition, the master piston 52 is adapted to be fixed to the third interior portion 55 selectively. For this purpose, a latching cylinder 54 is formed horizontally in the master piston 52, and latching pistons 58*a* and 58*b* are movably inserted in the latching cylinder 54. In addition, a partition 56 is formed at a middle portion of the latching cylinder 54, and latching springs 60*a* and 60*b* for pushing the latching pistons 58*a* and 58*b* toward the third interior portion 55 are interposed between the partition 56 and the latching pistons 58*a* and 58*b*. In addition, a latching groove 64 in which the latching pistons 58*a* and 58*b* are selectively inserted is formed at the third interior portion 55, and the latching groove 64 is connected to a fourth supply line 62 so as to supply hydraulic pressure to the latching pistons 58*a* and 58*b* against elastic force of the latching springs 60*a* and 60*b*. If the latching pistons 58*a* and 58*b* are inserted in the latching groove 64 by the elastic force of the latching springs 60*a* and 60*b*, the master piston 52 is fixed to the third interior portion 55. If hydraulic pressure is supplied to the fourth supply line 62 from the hydraulic pump or the oil control valve at this state, the hydraulic pressure pushes the latching pistons 58*a* and 58*b* into the master piston 52 and thereby the master piston 52 is decoupled from the third interior portion 55 so as to move upwardly or downwardly.

The slave piston 72 is disposed under the master piston 52 with a distance. The slave piston 72 is adapted to be movable in the second housing 51. The slave piston 72 includes an upper end portion 82 and a middle portion 84 integrally connected to the upper end portion 82. One will appreciate that the upper end portion and the middle portion may be monolithically formed. A diameter of the upper end portion 82 is larger than that of the middle portion 84. The upper end portion 82 is positioned at the third interior portion 55 and the middle portion 84 is positioned at the fourth interior portion 57. Therefore, a diameter of the upper end portion 82 is almost the same as that of the third interior portion 55, and a diameter of the middle portion 84 is almost the same as that of the fourth interior portion 57. As shown in FIG. 3, a connecting line 86 which connects an exterior circumference of the middle portion 84 with a lower end of the slave piston 72 is formed in the slave piston 72.

The piston chamber 94 is formed by the master piston 52, the slave piston 72, and the third interior portion 55. The piston chamber 94 is connected to the second supply line 68 so as to receive hydraulic pressure. The hydraulic pressure supplied to the piston chamber 94 through the second supply line 68 is applied to the slave piston 72 when the master piston 52 moves downwardly. Therefore, the slave piston 72 also moves downwardly.

A stopper 70 is disposed at a lower portion of the piston chamber 94. The stopper 70 is fixed to the third interior portion 55 and restricts upward movement of the slave piston 72. The stopper 70 is an annular shape and is adapted that the hydraulic pressure of the piston chamber 94 can be applied to the slave piston 72. In addition, the first spring 66 is interposed between the stopper 70 and the lower end of the master piston 52. The first spring 66 exerts elastic force on the master piston 52 upwardly.

The second brake chamber 80 is formed between a lower end of the upper end portion 82 and a lower end portion of the third interior portion 55 (i.e., a stepped surface between the third interior portion 55 and the fourth interior portion 57). A volume of the second brake chamber 80 is changed according to movement of the slave piston 72. That is, the volume of the second brake chamber 80 decreases if the slave piston 72 moves downwardly, and the volume of the second brake chamber 80 increases if the slave piston 72 moves upwardly. If the slave piston 72 moves downwardly, oil in the second brake chamber 80 flows out from the second brake chamber 80 through the connecting line 86 and performs brake operation. For this purpose, a diameter of the connecting line 86 is sufficiently small. In addition, the second brake chamber 80 is selectively connected to the third supply line 76 so as to selectively receive hydraulic pressure from the third supply line 76. That is, the third supply line 76 is closed if the slave piston 72 moves downwardly and the third supply line 76 is open if the slave piston 72 moves upwardly.

The second spring 74 is interposed between the slave piston 72 and the second housing 51 so as to apply elastic force to the slave piston 72 against the hydraulic pressure of the piston chamber 94.

The exhaust line 78 is formed at a lower end of the second housing 51. If the slave piston 72 moves downwardly, the oil in the second brake chamber 80 flows out from the second brake chamber 80 through a space between the middle portion 84 of the slave piston 72 and the fourth interior portion 57. The oil moves toward a lower portion of the second housing 51 by gravity. After that, the oil flows to an oil reservoir through the exhaust line 78.

Figure 4:
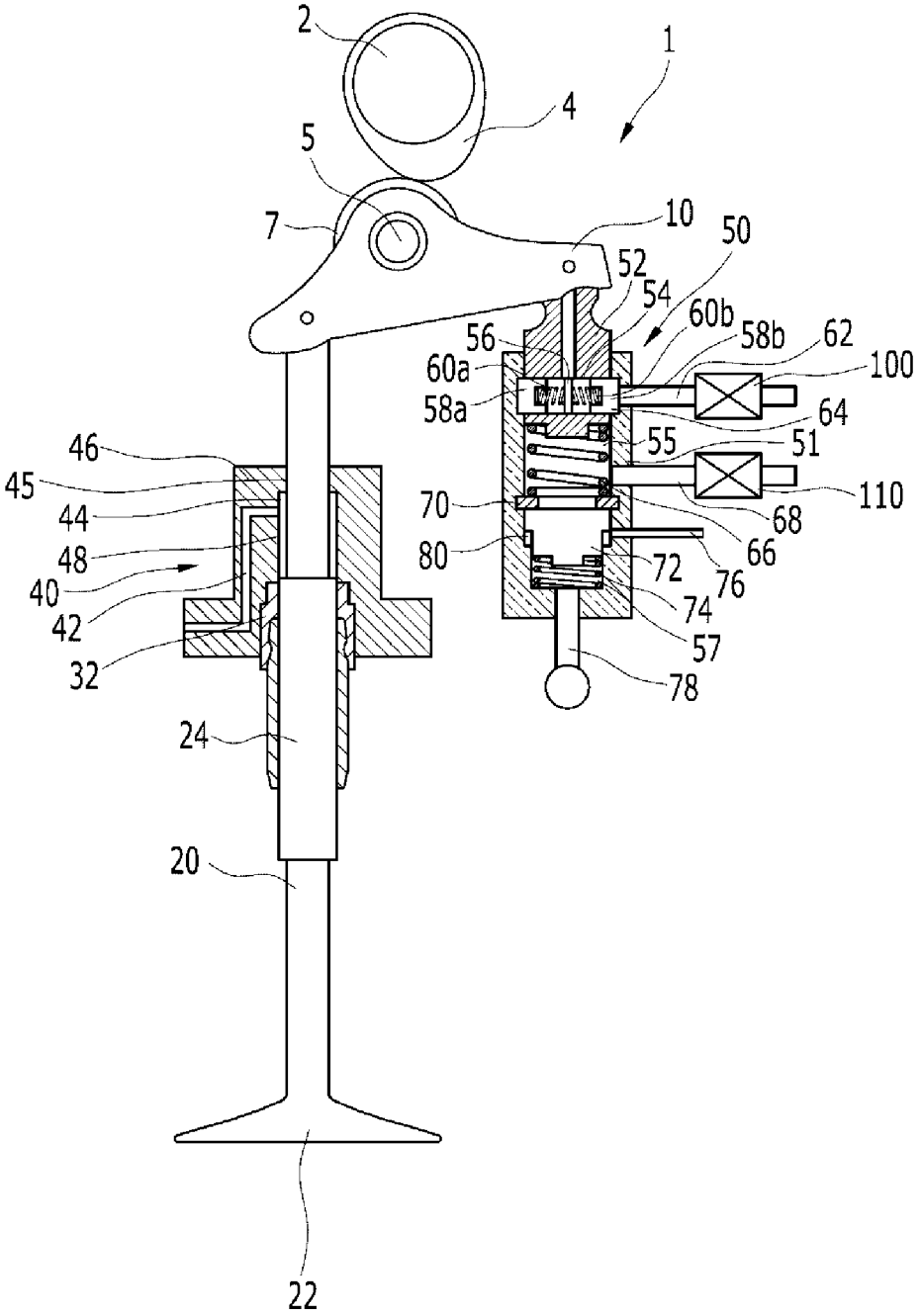
FIG. 4 is a schematic diagram of an exemplary electro-hydraulic valve train according to the present invention when a valve is fully open.
Figure 5:
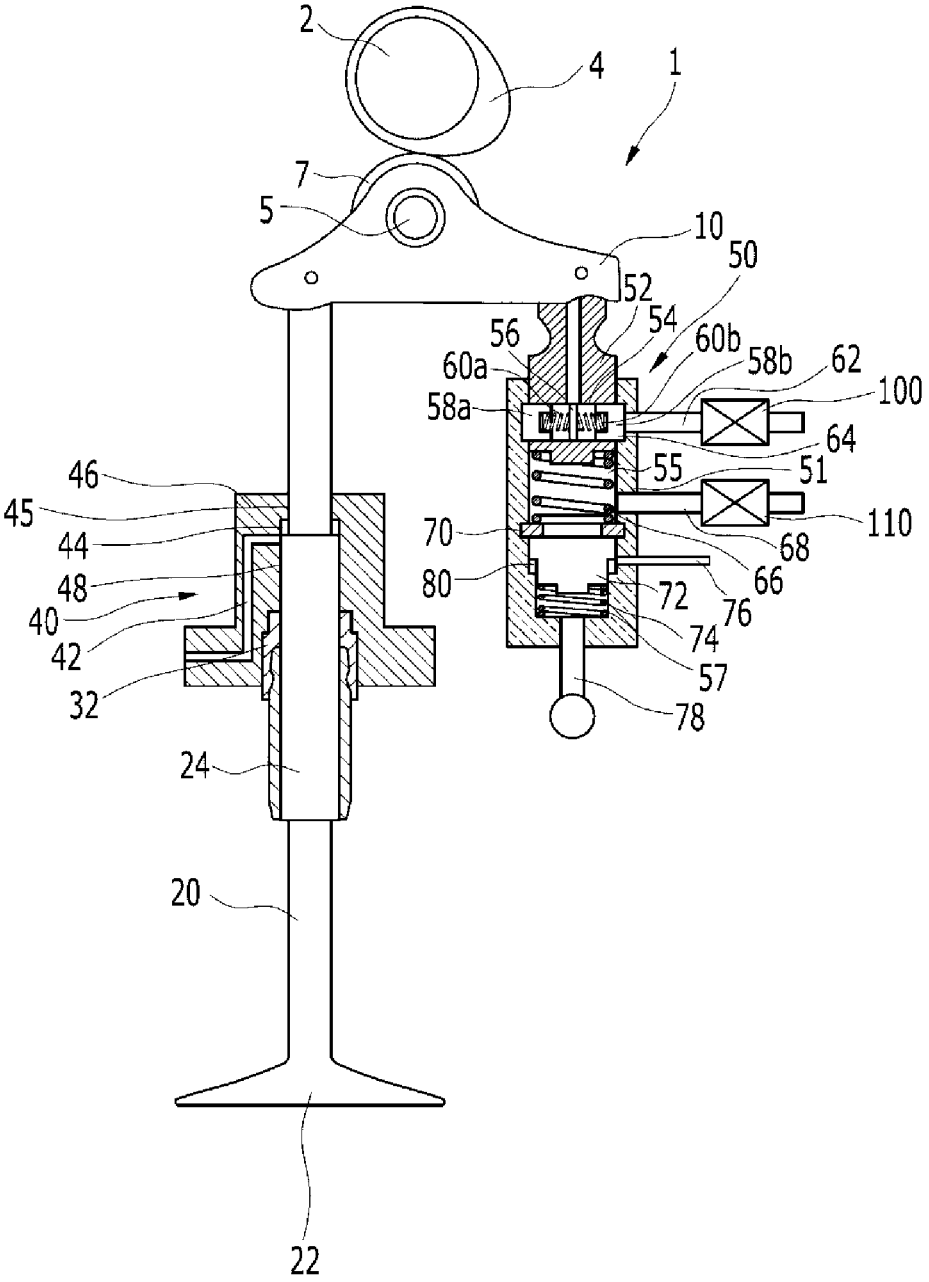
FIG. 5 is a schematic diagram of the electro-hydraulic valve train of FIG. 4 showing an operation of the first brake unit.
Figure 6:
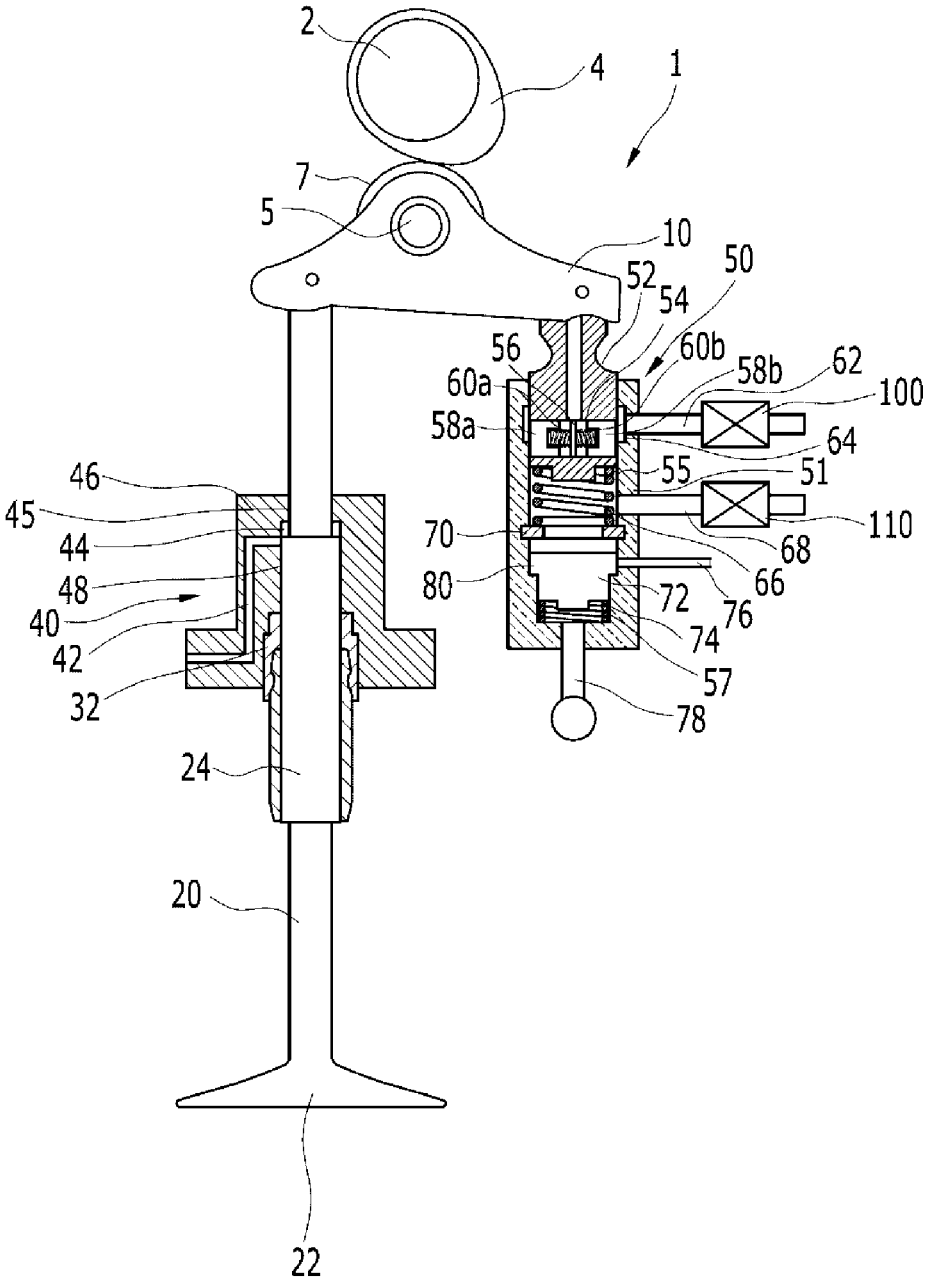
FIG. 6 is a schematic diagram of the electro-hydraulic valve train of FIG. 4 showing an operation of the second brake unit.

Referring to FIG. 4 to FIG. 6, an operation of the electro-hydraulic valve train according to various embodiments of the present invention will hereinafter be described in detail.

The state where the valve head 22 opens the intake port or the exhaust port completely is disclosed in FIG. 4. If the camshaft 2 rotates at this state as shown in FIG. 5, the valve stem 20 moves upwardly and the big-diameter stem 24 closes the first supply line 42. In addition, the oil remaining in the first brake chamber 44 impedes the upward movement of the valve stem 20. If the valve stem 20 further moves upwardly at this state, the oil remaining in the first brake chamber 44 flows out from the first brake chamber 44 through the space between the big-diameter stem 20 and the first interior portion 48. At this time, closing timing of the valve is delayed and ramp is generated.

A state where the second brake unit 50 does not support the other end of the swing arm 10 when the camshaft 2 rotates is disclosed in FIG. 6. As shown in FIG. 6, if the first oil control valve 100 applies the hydraulic pressure to the latching pistons 58*a* and 58*b* through the fourth supply line 62, the latching pistons 58*a* and 58*b* are departed from the latching groove 64 and are inserted in the latching cylinder 54. Therefore, the master piston 52 is released from the third interior portion 55.

At this state, the second oil control valve 110 supplies the oil to the piston chamber 94 through the second supply line 68 and closes the second supply line 68.

If the camshaft 2 rotates and pushes the swing arm 10 downwardly at this state, the master piston 52 moves downwardly and pressurizes the oil in the piston chamber 94. The oil in the piston chamber 94 exerts force on the slave piston 72. Therefore, the slave piston 72 moves downwardly such that the upper end portion 82 of the slave piston closes the third supply line 76 and the oil remaining in the second brake chamber 80 impedes downward movement of the slave piston 72. If the slave piston 72 further moves downwardly at this state, the oil remaining in the second brake chamber 80 flows out from the second brake chamber 80 through the connecting line 86. At that time, downward speed of the slave piston 72 decreases and ramp is generated. In addition, since the master piston 52 moves downwardly, the other end of the swing arm 10 also moves downwardly. Therefore, a pivoting center of the swing arm 10 moves and thereby valve lift is changed.

Figure 7:
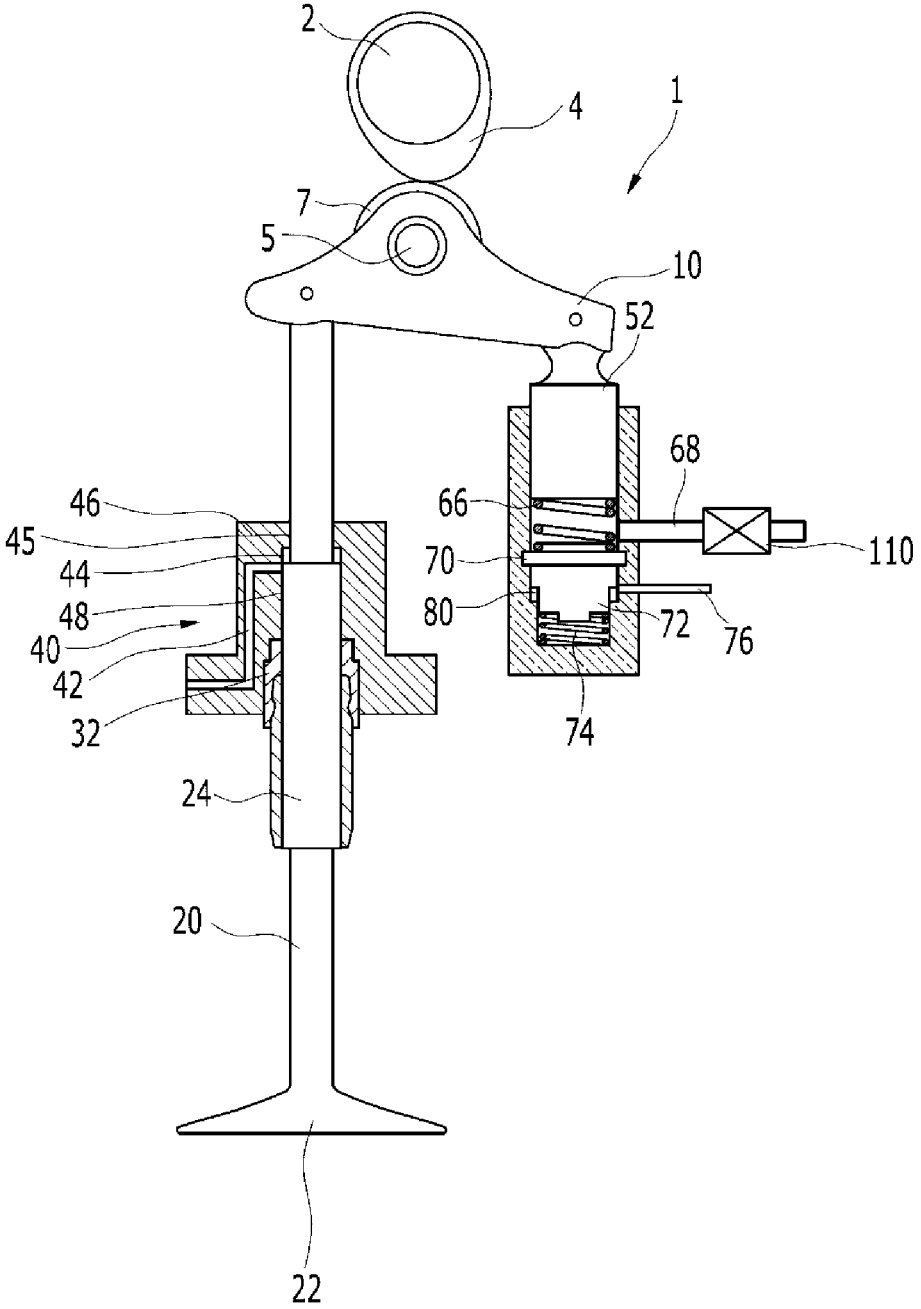
FIG. 7 is a cross-sectional view of another exemplary electro-hydraulic valve train according to the present invention.

FIG. 7 is a cross-sectional view of an electro-hydraulic valve train according to other embodiments of the present invention. The illustrated electro-hydraulic valve train 1 is the same as that described above except for structure of the master piston 52.

The illustrated electro-hydraulic valve train 1 does not include structures (the latching piston, the latching spring, the latching cylinder, and so on) that selectively fix the master piston 52 to the third interior portion 55. Instead, the master piston 52 is supported by hydraulic pressure supplied to the piston chamber 94 and elastic forces of the first and second springs 66 and 74. In this case, since the master piston 52 is not fixed to the third interior portion 55, the master piston 52 moves upwardly or downwardly by rotation of the camshaft 2 and accordingly the slave piston 72 also moves upwardly or downwardly.

Figure 8:
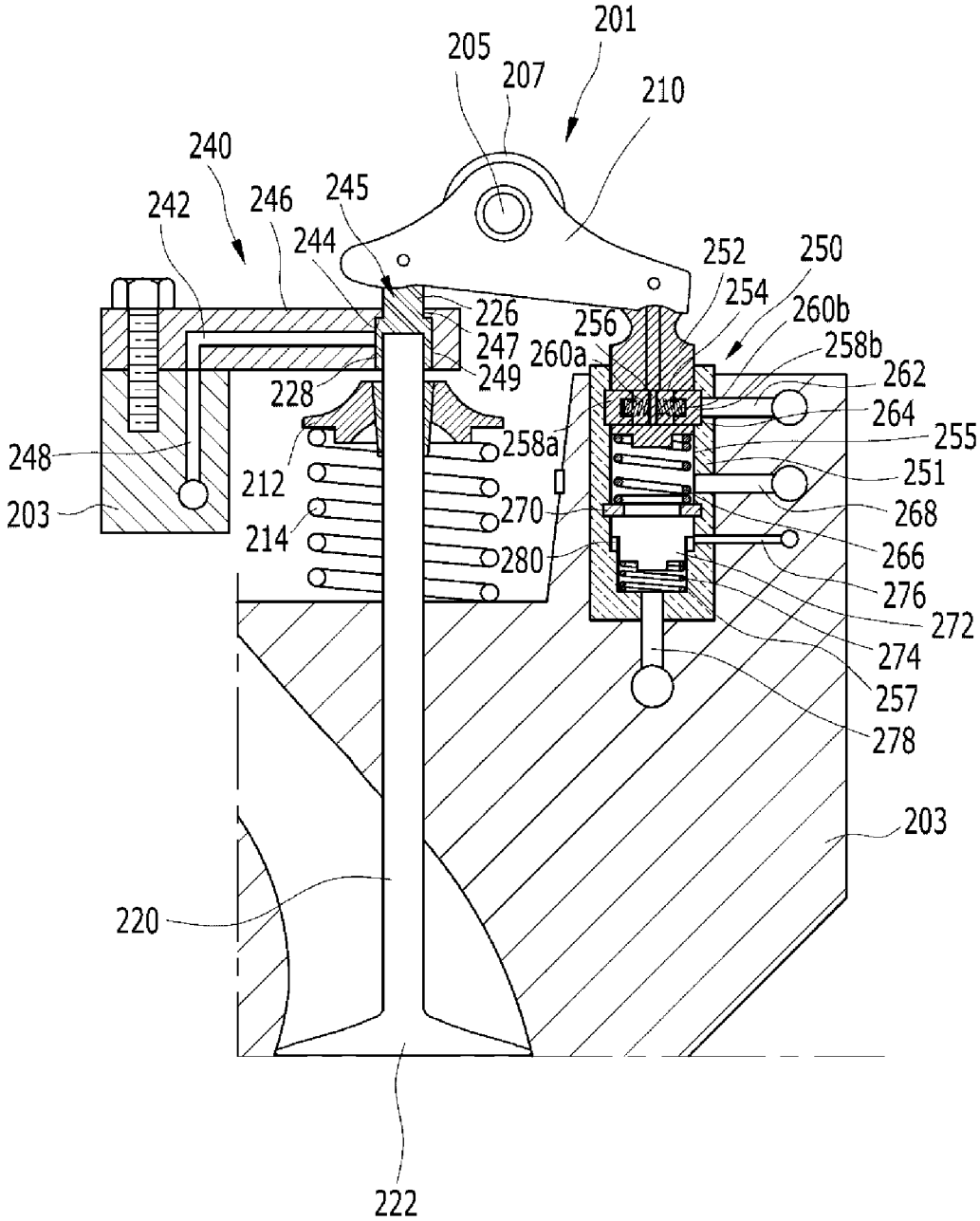
FIG. 8 is a cross-sectional view of another exemplary electro-hydraulic valve train according to the present invention.

As shown in FIG. 8, an electro-hydraulic valve train 201 according various embodiments of the present invention is applied to the engine of swing arm type. That is, the swing arm 210 is provided at the upper portion of the cylinder head 203, and the camshaft 202 is provided above the swing arm 210. In addition, a brake piston 245 is rotatably connected to an end of the swing arm 210, the upper end portion of the valve stem 220 is coupled to a lower end of the brake piston 245, and the roller 207 contacting with the cam 204 of the camshaft 202 is rotatably connected to the upper end of the swing arm 210 through the roller shaft 205. Therefore, if the camshaft 202 rotates, the swing arm 210 pivots with respect to the other end thereof by the roller 207 contacting with the cam 204. Accordingly, the valve stem 220 coupled to the brake piston 245 moves upwardly or downwardly so as to close or open the intake port or the exhaust port. In addition, the spring seat 212 is disposed at a lower portion of the brake piston 245 such that the brake piston 245 closely contacts with the spring seat 212 if the swing arm 210 moves downwardly. The valve spring 214 is interposed between the spring seat 212 and the cylinder head 202. Therefore, the downward movement of the valve stem 220 is generated by the cam 204, and the upward movement of the valve stem 220 is generated by the valve spring 214.

The electro-hydraulic valve train 201 includes the brake piston 245, the valve stem 220, the first brake unit 240, and the second brake unit 250.

The brake piston 245 has a shape in which two circular cylinders having different diameters are integrally connected to each other. A small-diameter portion 226 having a smaller diameter is formed at an upper portion of the brake piston 245, and a big-diameter portion 228 having a larger diameter is formed at a lower portion of the brake piston 245.

The upper end of the valve stem 220 is coupled to the brake piston 245, and the valve head 222 for closing the intake port or the exhaust port is formed at a lower end of the valve stem 220.

As shown in FIG. 8, the first brake unit 240 encloses the brake piston 245 and is adapted to perform brake operation when the brake piston 245 moves upwardly (i.e., the valve is closed). For this purpose, the first brake unit 240 includes the first housing 246, the first brake chamber 244, and the first supply line 242.

The first housing 246 is a pipe shape extending horizontally. The first housing 246 is coupled to the upper end of the cylinder head 203 by a bolt or is integrally formed with the cylinder head 203. One will appreciate that these may be monolithically formed. An interior surface of one side portion of the first housing 246 includes the first interior portion 247 formed at an upper portion thereof and the second interior portion 249 formed under the first interior portion 247. A diameter of the first interior portion 247 is smaller than that of the second interior portion 249. The small-diameter portion 226 is positioned at the first interior portion 247 and the big-diameter portion 228 is positioned at the second interior portion 249. Therefore, the diameter of the first interior portion 247 is almost the same as that of the small-diameter portion 226 and the diameter of the second interior portion 249 is almost the same as that of the big-diameter portion 228. In addition, the first housing 246 is disposed between the end of the swing arm 210 and the spring seat 212.

The first brake chamber 244 is formed between an upper end of the big-diameter portion 228 and a lower end of the first interior portion 247 (i.e., the stepped surface between the first interior portion 247 and the second interior portion 249). Therefore, the volume of the first brake chamber 244 is changed according to a movement of the brake piston 245.

The first supply line 242 is formed along a length direction of the first housing 246 in the first housing 246, and is selectively connected to the first brake chamber 244. The first supply line 242 is connected to an oil line 248 formed at the cylinder head 203, and the oil line 248 is connected to the hydraulic pump or the oil control valve. Therefore, the first supply line 242 receives hydraulic pressure from the hydraulic pump or the oil control valve, and supplies the received hydraulic pressure to the first brake chamber 244 selectively. More concretely, the first supply line 242 is connected to the first brake chamber 244 and supplies the hydraulic pressure thereto in a state that the valve head 222 opens the intake port or the exhaust port. If the valve stem 220 and the brake piston 245 move upwardly at this state, the big-diameter portion 228 closes the first supply line 242 and the oil remaining in the first brake chamber 244 impedes upward movement of the brake piston 245. If the valve stem 220 and the brake piston 245 further move upwardly at this state, the oil remaining in the first brake chamber 244 flows out from the first brake chamber 244 through a space between the big-diameter portion 228 and the second interior portion 249. After that, the oil moves toward the oil reservoir through an exhaust line formed at the first supply line 242 or the second interior portion 249.

As shown in FIG. 8, the second brake unit 250 is mounted at the other end of the swing arm 210 and moves the other end of the swing arm 210 upwardly or downwardly. The second brake unit 250 is adapted to perform brake operation when the other end of the swing arm 210 moves downwardly. The second brake unit 250 is the same as or is closely similar to the second brake unit 50 shown in FIG. 1 to FIG. 7, and thus detailed description thereof will be omitted.

Figure 9:
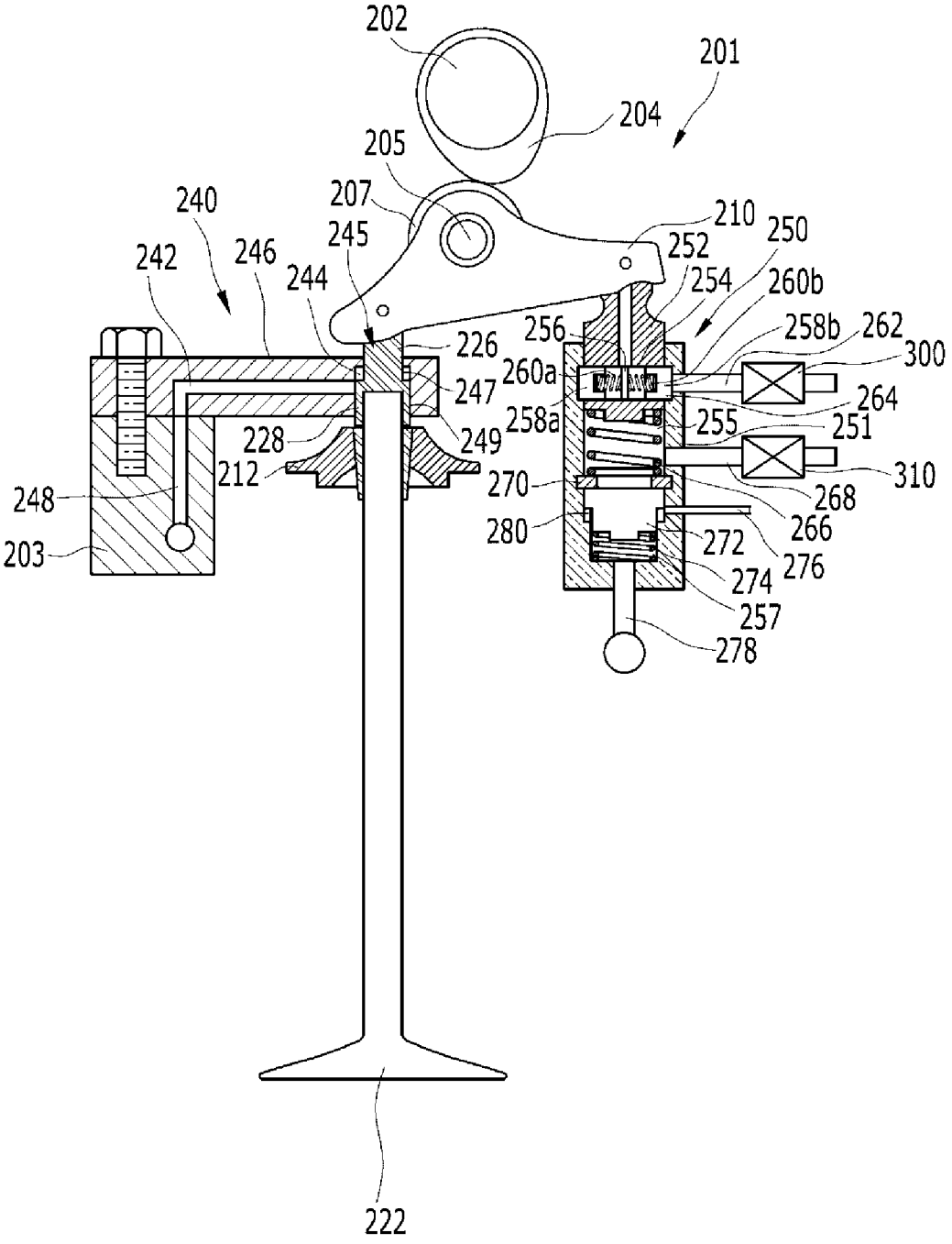
FIG. 9 is a schematic diagram of another exemplary electro-hydraulic valve train according to the present invention when a valve is fully open.
Figure 10:
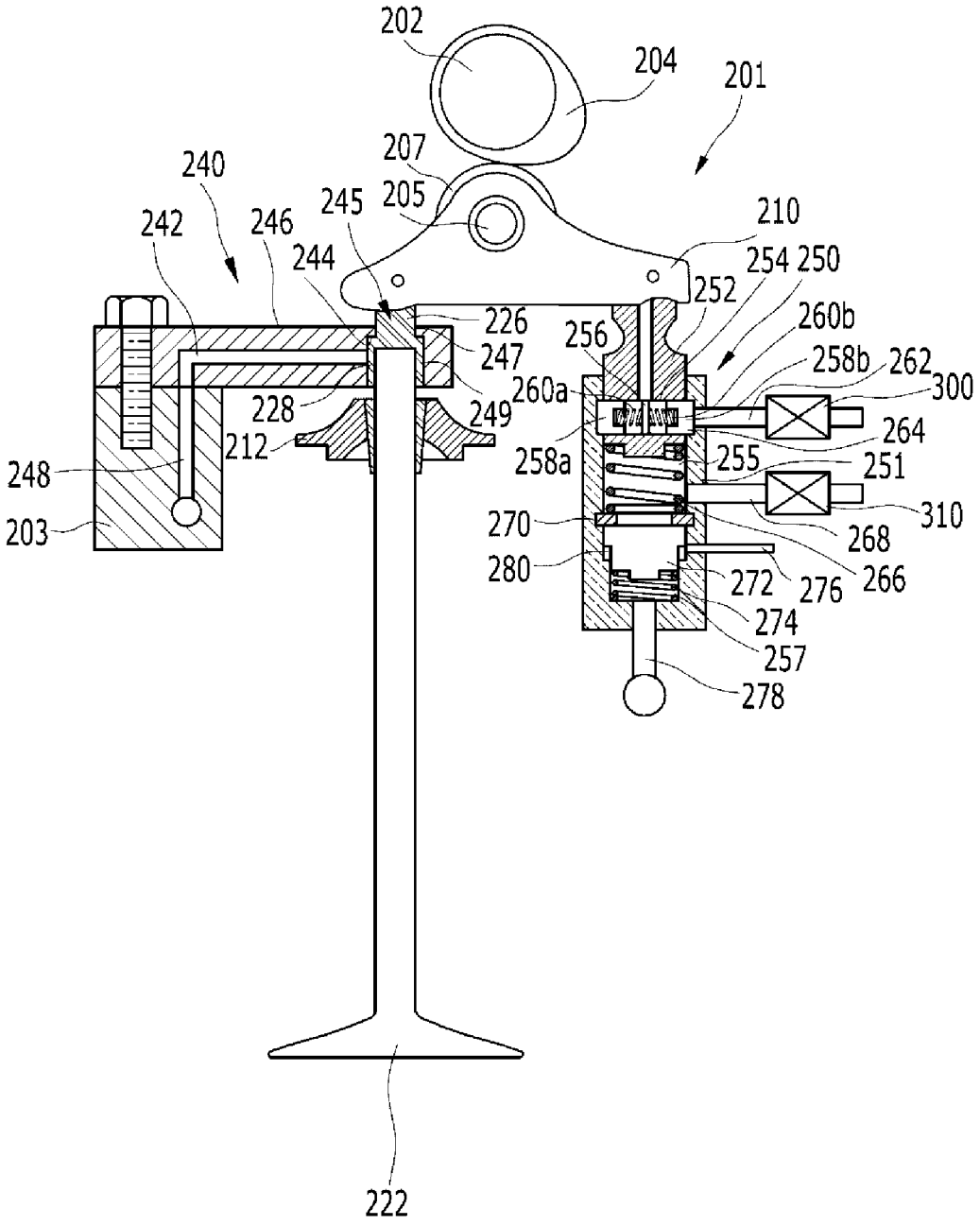
FIG. 10 is a schematic diagram of the electro-hydraulic valve train of FIG. 9 showing an operation of the first brake unit.

With reference to FIG. 9, the state where the valve head 222 opens the intake port or the exhaust port completely is disclosed. If the camshaft 202 rotates at this state as shown in FIG. 10, the valve stem 220 and the brake piston 245 move upwardly the big-diameter portion 228 closes the first supply line 242. In addition, the oil remaining in the first brake chamber 244 impedes the upward movement of the brake piston 245. If the valve stem 220 and the brake piston 245 further move upwardly, the oil remaining in the first brake chamber 244 flows out from the first brake chamber 244 through the space between the big-diameter portion 228 and the second interior portion 249. At this time, closing timing of the valve is delayed and ramp is generated.

Figure 11:
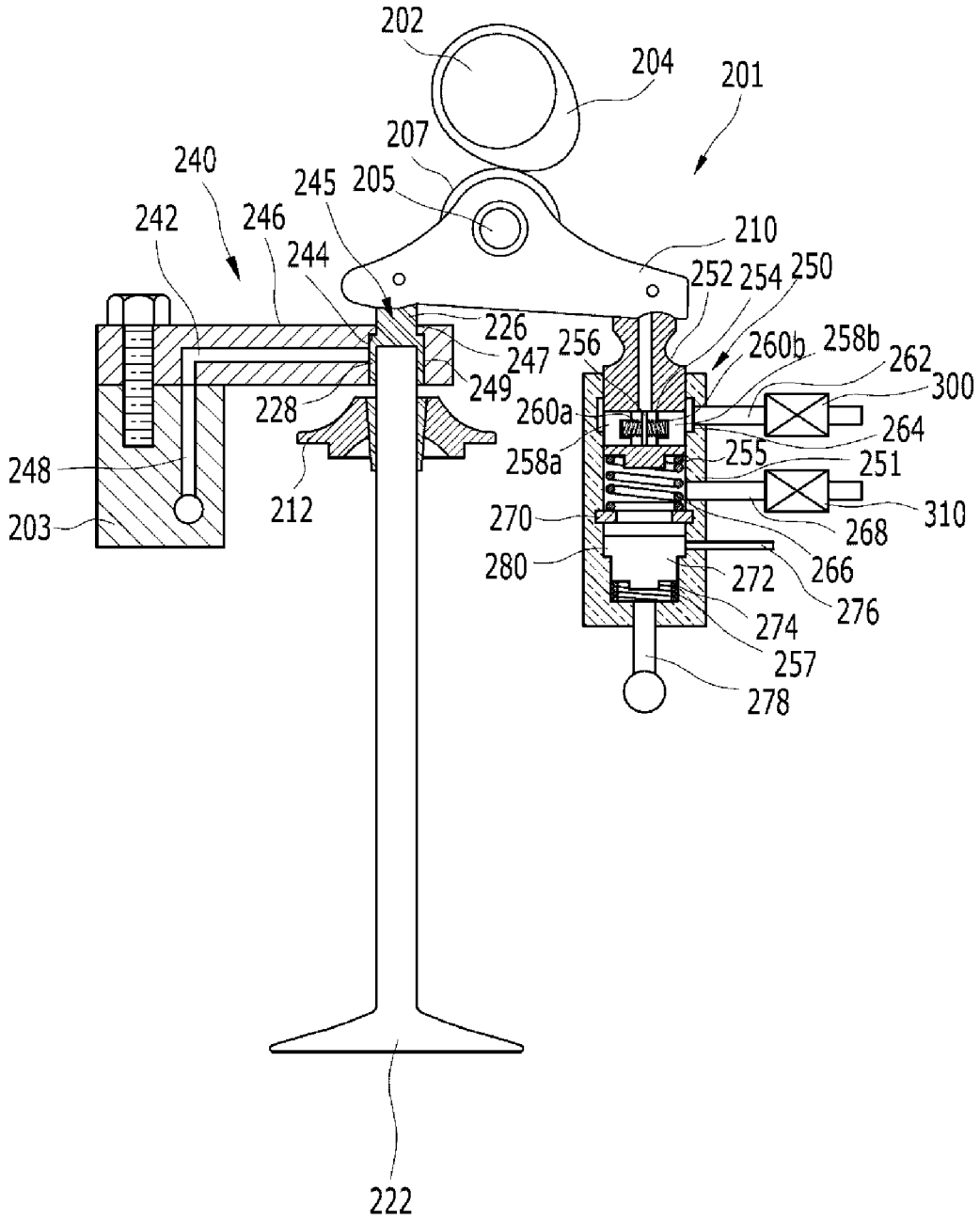
FIG. 11 is a schematic diagram of the electro-hydraulic valve train of FIG. 9 showing an operation of the second brake unit.

A state where the second brake unit 250 does not support the other end of the swing arm 210 when the camshaft 202 rotates is disclosed in FIG. 11. As shown in FIG. 11, if the first oil control valve 300 applies the hydraulic pressure to the latching pistons 258*a* and 258*b* through the fourth supply line 262, the latching pistons 258*a* and 258*b* are departed from the latching groove 264 and are inserted in the latching cylinder 254. Therefore, the master piston 252 is released from the third interior portion 255.

At this state, the second oil control valve 310 supplies the oil to the piston chamber 294 through the second supply line 268 and closes the second supply line 268.

If the camshaft 202 rotates and pushes the swing arm 210 downwardly at this state, the master piston 252 moves downwardly and pressurizes the oil in the piston chamber 294. The oil in the piston chamber 294 exerts force on the slave piston 272. Therefore, the slave piston 272 moves downwardly such that the upper end portion 282 of the slave piston closes the third supply line 276 and the oil remaining in the second brake chamber 280 impedes downward movement of the slave piston 272. If the slave piston 272 further moves downwardly at this state, the oil remaining in the second brake chamber 280 flows out from the second brake chamber 280 through the connecting line 286. At that time, the downward speed of the slave piston 272 decreases and ramp is generated. In addition, since the master piston 252 moves downwardly, the other end of the swing arm 210 also moves downwardly. Therefore, a pivoting center of the swing arm 210 moves and thereby valve lift is changed.

Figure 12:
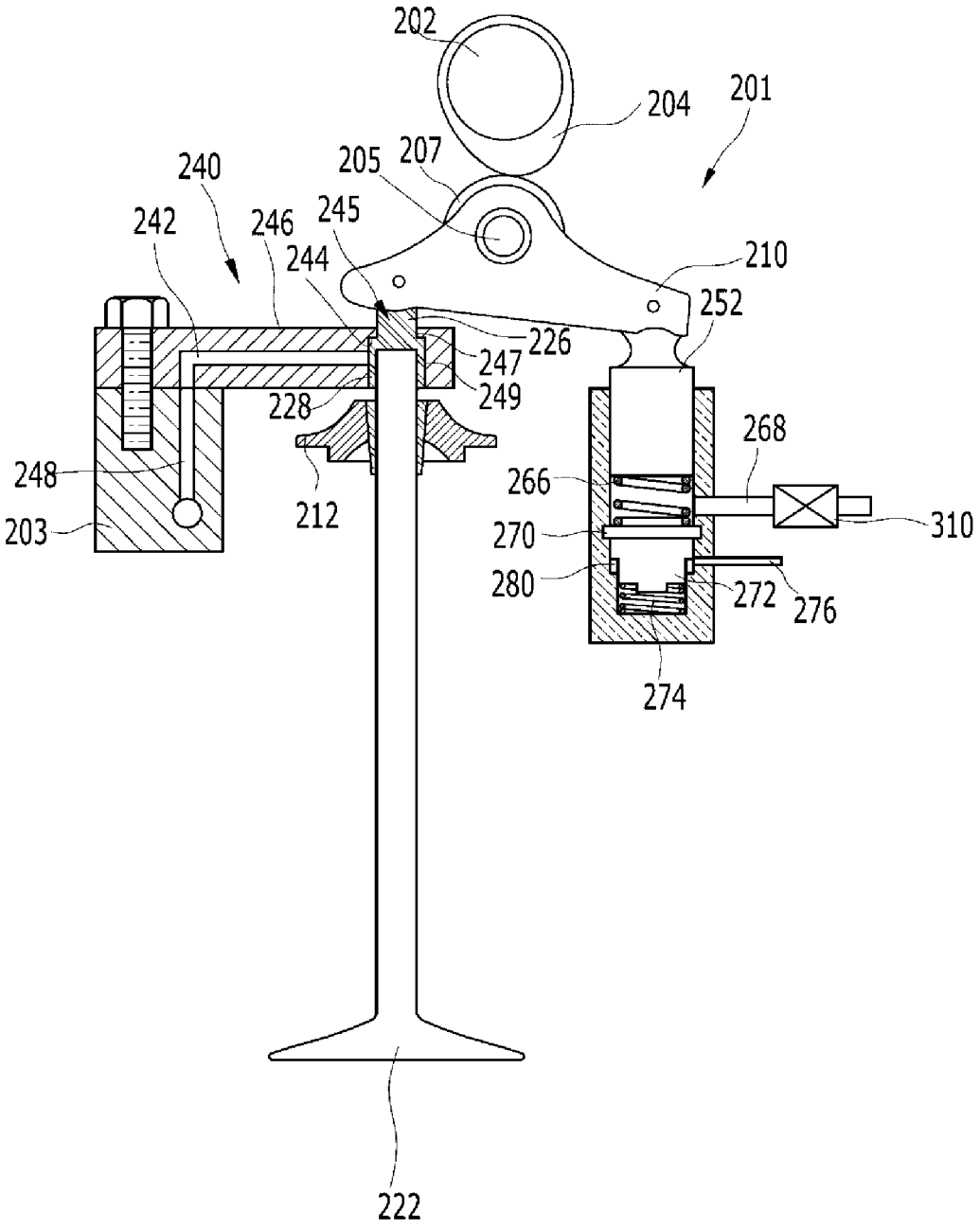
FIG. 12 is a cross-sectional view of another exemplary electro-hydraulic valve train according to the present invention.

FIG. 12 is a cross-sectional view of an electro-hydraulic valve train according to various embodiments of the present invention.

The illustrated electro-hydraulic valve train 201 does not include structures (the latching piston, the latching spring, the latching cylinder, and so on) that selectively fix the master piston 252 to the third interior portion 255. Instead, the master piston 252 is supported by hydraulic pressure supplied to the piston chamber 294 and elastic forces of the first and second springs 266 and 274. In this case, since the master piston 252 is not fixed to the third interior portion 255, the master piston 252 moves upwardly or downwardly by rotation of the camshaft 202 and accordingly the slave piston 272 also moves upwardly or downwardly.

As described above, brake units are mounted respectively at a valve portion and pivot portion of a valve train according to various embodiments of the present invention. Therefore, opening/closing timing of the valve can be controlled. In addition, an electro-hydraulic valve train can be mounted at an engine using the valve train of swing arm type without changing engine layout.

Further, valve lift can be changed as a consequence that a brake unit mounted at the pivot portion of the swing arm changes a position of the pivot portion.

For convenience in explanation and accurate definition in the appended claims, the terms upper or lower, front or rear, inside or outside, and etc. are used to describe features of the exemplary embodiments with reference to the positions of such features as displayed in the figures.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the Claims appended hereto and their equivalents.

What is claimed is:

1. An electro-hydraulic valve train, comprising:

a brake piston having a small-diameter portion formed at an upper portion of the brake piston and a big-diameter portion having a smaller diameter than the small-diameter portion and formed at a lower portion of the brake piston;

a valve stem having a valve head formed at a lower end thereof and an upper end portion coupled with the brake piston;

a swing arm having a roller contacting with a cam of a camshaft, and a first end coupled to an upper end of the brake piston, the first end of the swing arm being adapted to pivot with respect to a second end of the swing arm according to a rotation of the cam to move the valve stem and the brake piston upwardly or downwardly;

a first brake unit enclosing the small-diameter portion and the big-diameter portion of the brake piston and adapted to perform brake operation when the brake piston moves upwardly; and a second brake unit mounted at the second end of the swing arm and adapted to selectively move the second end of the swing arm upwardly or downwardly and to perform brake operation when the second end of the swing arm moves downwardly.

2. The electro-hydraulic valve train of claim 1, wherein the first brake unit comprises:

a first housing having a first interior portion at which the small-diameter portion is positioned and a second interior portion formed at a lower portion of the first interior portion, the big-diameter portion being positioned at the second interior portion;

a first brake chamber formed between an upper end of the big-diameter portion and an upper end portion of the first interior portion; and a first supply line connected to the first brake chamber to supply hydraulic pressure thereto, formed at the first housing, and adapted to be closed by the big-diameter portion.

3. The electro-hydraulic valve train of claim 2, wherein the hydraulic pressure supplied to the first brake chamber is adapted to impede upward movement of the brake piston and to flow out from the first brake chamber through a space between the big-diameter portion and the second interior portion when the brake piston moves upwardly.

4. The electro-hydraulic valve train of claim 1, wherein the second brake unit comprises:

a second housing being hollow shape and having a third interior portion and a fourth interior portion formed at a lower portion of the third interior portion and having a smaller diameter than the third interior portion;

a master piston coupled to the second end of the swing arm and movably inserted in the third interior portion;

a slave piston disposed under the master cylinder with a distance, and having an upper end portion movably inserted in the third interior portion and a middle portion integrally connected to a lower end of the upper end portion and movably inserted in the fourth interior portion;

a piston chamber formed by the master piston, the slave piston, and the third interior portion;

a second brake chamber formed between a lower end of the upper end portion of the slave piston and a lower end portion of the third interior portion;

a second supply line adapted to supply hydraulic pressure to the piston chamber; and a third supply line connected to the second brake chamber to supply hydraulic pressure thereto, and adapted to be selectively closed by the upper end portion of the slave piston.

5. The electro-hydraulic valve train of claim 4, wherein the second brake unit further comprises a first spring disposed in the piston chamber and adapted to supply elastic force pushing the master piston toward the swing arm.

6. The electro-hydraulic valve train of claim 5, wherein the second brake unit further comprises a stopper fixed to the third interior portion to support the first spring and restricting an upward movement of the slave piston.

7. The electro-hydraulic valve train of claim 4, wherein the second brake unit further comprises a connecting line connecting an exterior circumference of the middle portion and a lower end of the slave piston and connected to the second brake chamber to flow out hydraulic pressure of the second brake chamber.

8. The electro-hydraulic valve train of claim 4, further comprising a second spring interposed between the second housing and the lower end of the slave piston and supplying elastic force pushing the slave piston toward the master piston.

9. The electro-hydraulic valve train of claim 4, wherein the second brake unit further comprises a latching piston selectively fixing the master cylinder to the second housing.

10. The electro-hydraulic valve train of claim 9, wherein the latching piston is movable horizontally in the master cylinder, and the third interior portion having a latching groove in which the latching piston is selectively inserted.

11. The electro-hydraulic valve train of claim 10, wherein the latching groove is connected to a fourth supply line supplying hydraulic pressure to the latching piston, and a latching spring supplying elastic force to the latching piston against the hydraulic pressure is mounted in the master cylinder.

* * * * *